US005531040A

United States Patent [19]

Moore

[11] Patent Number: 5,531,040

[45] Date of Patent: Jul. 2, 1996

[54] LASER MODULE MOUNTING MEANS FOR WEAPONS AND OTHER APPLICATIONS

[75] Inventor: Larry Moore, Cottonwood, Ariz.

[73] Assignee: Tac Star Industries, Inc., Cottonwood, Ariz.

[21] Appl. No.: 344,174

[22] Filed: Nov. 23, 1994

Related U.S. Application Data

[63] Continuation-in-part of Ser. No. 8,679, Jan. 25, 1993, Pat. No. 5,419,072, which is a continuation-in-part of Ser. No. 4,451, Jan. 14, 1993, Pat. No. 5,392,550.

[51] Int. Cl.[6] ..... F41G 1/36

[52] U.S. Cl. ..... 42/103; 362/114; 385/52

[58] Field of Search ..... 42/103; 362/110, 362/113, 114; 372/65, 108, 98; 385/52, 138

[56] References Cited

U.S. PATENT DOCUMENTS

| | | | |
|---|---|---|---|
| 4,212,109 | 7/1980 | Snyder | 362/110 |
| 4,730,335 | 3/1988 | Clark et al. | 372/98 |
| 5,095,517 | 3/1992 | Monguzzi et al. | 385/52 |

FOREIGN PATENT DOCUMENTS

| | | | |
|---|---|---|---|
| 1286707 | 1/1962 | France | 42/103 |

*Primary Examiner*—Stephen M. Johnson
*Attorney, Agent, or Firm*—Michael A. Lechter

[57] ABSTRACT

An internally mounted light beam sight suitable for use in automatic pistols and other weapons is provided by replacing the conventional recoil spring guide rod with a hollow tube having substantially the same exterior shape and dimensions, but containing a laser beam generation module within its hollow bore. A collar surrounds the module near a first end. The collar has a part-spherical outer surface which engages a matching-spherical inner surface within the tube so that the angular orientation of the module may be adjusted by relative rotation of the two part-spherical surfaces. The collar is desirably split by one cut-through so that it may be spread apart to slip over an end of the module. The module and collar have an interlocking groove and ridge which retains the collar in place on the module. Transverse adjustment screws in the tube bear on a distal end of the module so that the angular orientation of the module may be varied with respect to the tube. This allows the light beam provided by the module to be properly aimed to compensate for variations in the angle of emergence of the light beam from the module.

19 Claims, 6 Drawing Sheets

LASER MODULE MOUNTING MEANS FOR WEAPONS AND OTHER APPLICATIONS

This is a Continuation-In-Part of patent application Ser. No. 08/008,679 filed Jan. 25, 1993, now U.S. Pat. No. 5,419,072 which is a Continuation-In-Part of patent application Ser. No. 08/004,451 filed Jan. 14, 1993, now U.S. Pat. No. 5,392,550.

FIELD OF THE INVENTION

The present invention concerns an improved means and method for supporting and aligning a light emitting module and, more particularly, an internally mountable light emitting module aiming device for weapons and weapons containing such.

BACKGROUND OF THE INVENTION

It is well known in the art to utilize a light beam as a sighting aid for weapons. An illumination source is provided that projects a narrow beam of light in a direction parallel to the weapon boresight. When light beam and boresight are properly aligned, the bullet impact will be on or very close to the location of the light spot on the target. Light beam sighting aids are particularly useful at night when ordinary iron or telescopic sights are difficult to use because of low ambient and/or target illumination levels.

Lasers are the preferred means of generating light beams for sighting applications. They have comparatively high intensity, small spot size, and can be focused into a narrow beam with a very small divergence angle. Laser sights for weapons are well known in the art.

Heretofore, laser sights have been comparatively bulky and mounted outside of the weapon. With long guns, the bulk required for the laser sight is small compared to the size of the gun, that is, the additional volume and weight are a small percentage of the volume and weight of the gun itself. However, with hand guns, the typical externally mounted laser sight is a significant fraction of the volume of the gun itself and a gun with such a sight cannot generally be carded in a conventional holster. This is a great disadvantage, both because of the additional space required for the laser sight, and also because the externally mounted laser sight is comparatively easily damaged or knocked out of alignment. In police and military applications, there is a great premium on compact and extremely rugged weapons. Thus, there is a great desire to have a laser sight which is internal to the weapon so as to be protected from rough handling and which does not add to the bulk of the weapon.

It is known in the art to provide a light source within a hand gun such as a semiautomatic pistol. For example, a light emitting diode or a fiber-optic light conductor coupled to a light emitting diode, is mounted so as to project a light beam along the bore of a hollow recoil spring guide tube within the weapon. The recoil spring guide tube is located beneath the barrel. The direction and alignment of the light beam is determined by the direction and alignment of the guide tube. In pistols in which the recoil spring tube is parallel to the barrel, the light beam emanating from the recoil spring guide tube projects forward in the same general direction as the bullet travels. The battery and other electronics necessary to power the light emitting diode are mounted in the butt of the weapon.

However, such prior art approaches have several limitations, as for example, (i) no means is provided for adjusting the alignment of the light beam relative to the weapon boresight, (ii) substantial modification of the weapon may be needed to accommodate the battery, drive circuitry, and fiber-optic or electrical connections leading to the light emitter, and (iii) the light emitting diode mounted in the guide tube is poorly protected from shock and/or heat generated by firing the weapon. Modification of a weapon to accommodate such spaced-apart or remotely located components may require a skilled gunsmith. This limits the applicability of such an internal laser sight arrangement to those who can afford such modifications to their weapons, and to weapons which have sufficient un-used space within the butt or frame to accommodate the spaced-apart components. Thus, there continues to be a need for an improved, internally mounted laser sight for hand guns and for angularly adjustable laser emitting assemblies for this and other applications.

DETAILED DESCRIPTION OF THE PREFERRED EMBODIMENT

Figure 1:
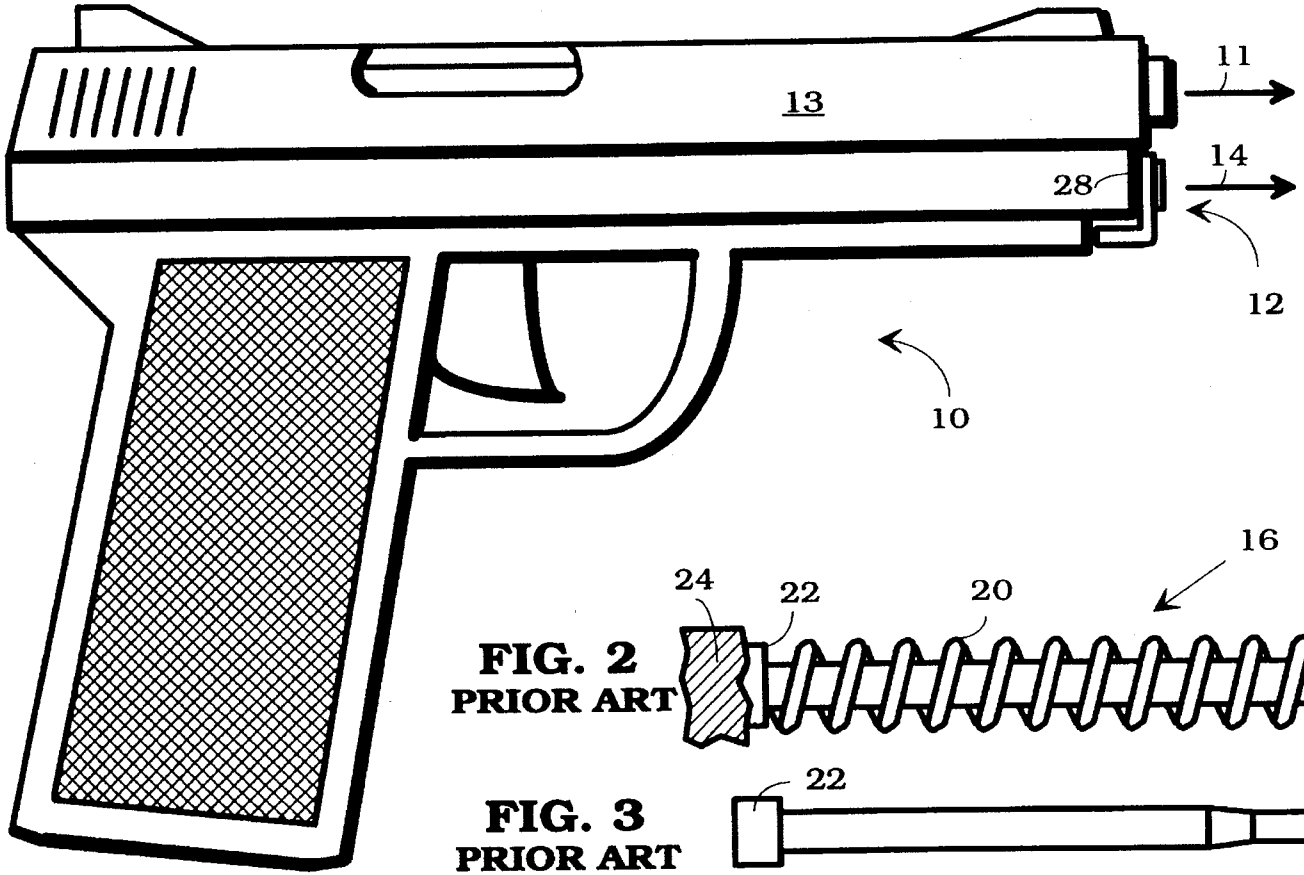
FIG. 1 is a simplified side view of a semi-automatic pistol containing a laser sighting assembly according to the present invention.

FIG. 1 is a simplified side view of semi-automatic pistol 10 adapted to fire projectiles in bore-sight direction 11, and in which has been mounted light beam aiming assembly 12 producing emergent light beam 14, according to a first embodiment of the present invention. Except for light beam aiming assembly 12, the other portions of weapon 10 are, generally, substantially conventional. The pistol depicted in FIG. 1 is in a non-firing state. Portion 13 of weapon 10 contains the breach and is referred to as the "slide". Slide 13 moves back and forth parallel to direction 11 when the weapon is fired.

Figure 2:
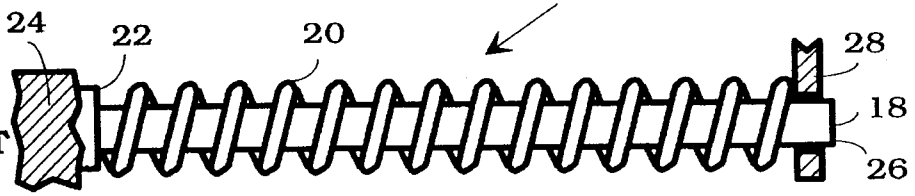
FIG. 2 PRIOR ART
FIG. 2 is a simplified partial cut-away side view of a conventional recoil spring and guide rod assembly according to the prior art.
Figure 3:
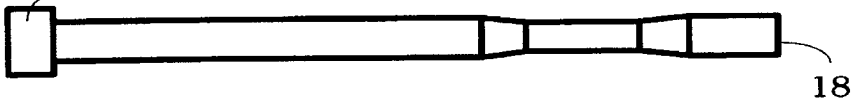
FIG. 3 PRIOR ART
FIGS. 3–4 are simplified side views of recoil spring guide rods according to the prior art, similar to that shown in FIG. 2, but without the recoil spring.
Figure 4:
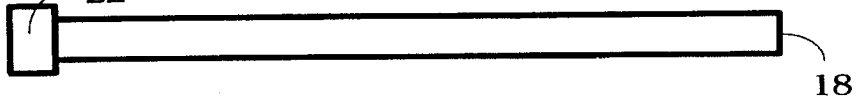
FIG. 4 PRIOR ART

FIG. 2 is a simplified partial cut-away side view of conventional recoil spring and guide rod assembly 16 according to the prior art. Assembly 16 would be contained within a pistol of the type shown in FIG. 1 if manufactured in the conventional manner without the light beam aiming assembly of the present invention. Assembly 16 comprises guide rod or tube 18 and spring 20. FIGS. 3–4 show prior art guide rods or tubes of various types with spring 20 removed, as would be seen when guide rod or tube 18 is removed from the weapon.

Figures 5, 6, 7, 8, 9:
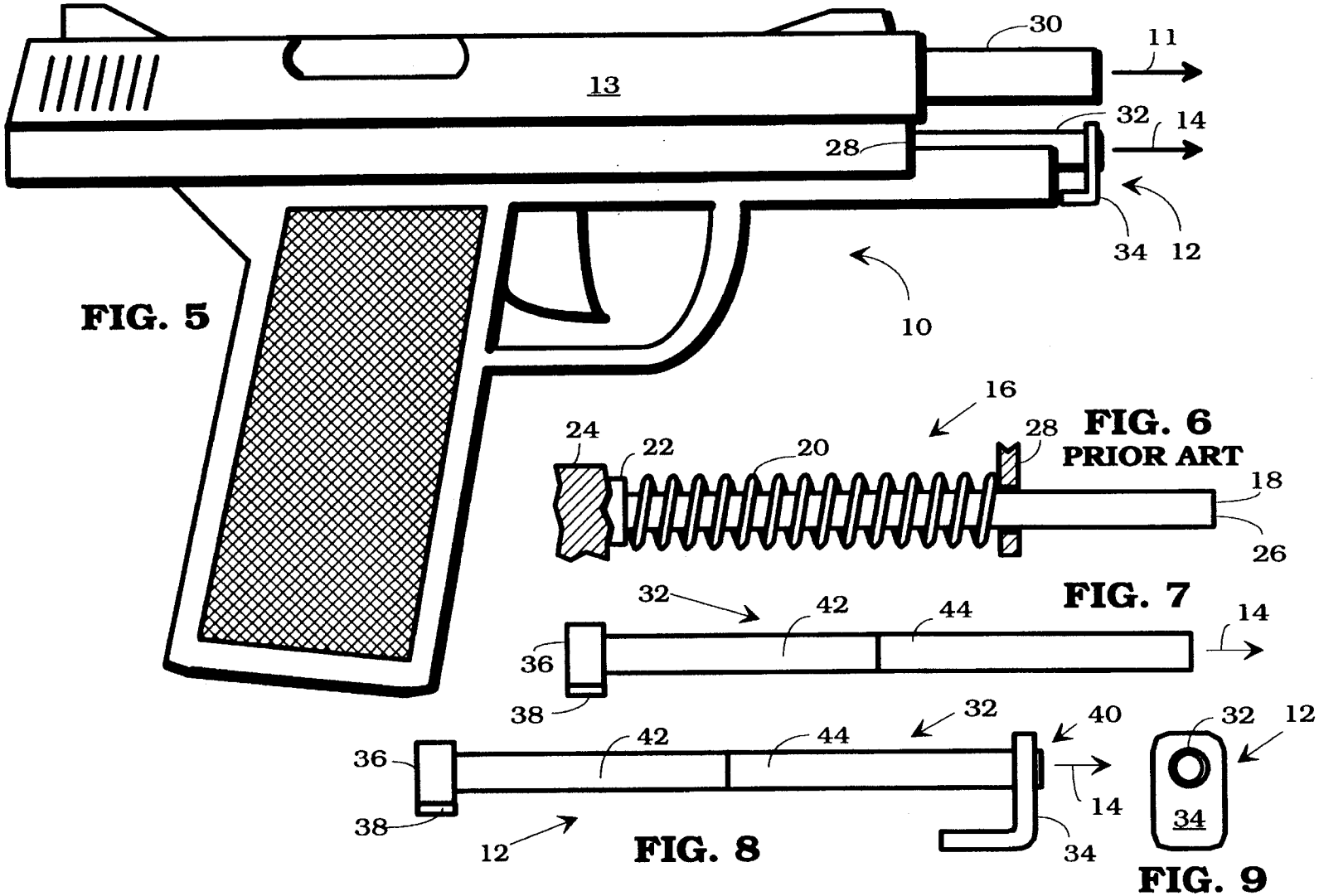
FIG. 6 PRIOR ART
FIG. 5 is a view similar to FIG. 1, but showing the location of the weapon slide when the weapon is firing and the breach has recoiled.
FIG. 6 is a view of the same prior art assembly as in FIG. 2 showing the compression of the recoil spring when the weapon in which it is contained is in the state depicted in FIG. 5.
FIG. 7 is a simplified side view of a recoil spring guide tube having therein a laser beam generation means, according to a first embodiment of the present invention.
FIG. 8 is a view of the tube of FIG. 7 according to the present invention, but with a rotational lever attached to the forward end.
FIG. 9 is a right side (end) view of the tube and lever of FIG. 8.

Guide rod or tube 18 has first end 22 which is generally fixed in relationship to portion 24 of the frame of gun 10, and second end 26 which has thereon movable portion 28 of gun 10. Movable portion 28 is generally coupled to slide 13 so that when the weapon fires and slide 13 recoils, portion 28 moves to the left along guide rod 18. FIG. 5 is a view similar to FIG. 1, but showing the location of weapon slide 13 and portion 28 when weapon 10 is firing and slide 13 has recoiled to expose barrel 30 and guide rod 32. FIG. 6 is a view of the same prior art assembly 16 as in FIG. 2 showing the compression of recoil spring 20 when the weapon in which it is contained is in the state depicted in FIG. 5.

FIG. 7 is a simplified side view of assembly 12 according to the present invention. Assembly 12 comprises guide tube 32 of substantially the same exterior dimensions as guide rod or tube 18. The laser beam generation means of the present invention is preferably entirely housed within tube 32. FIG. 8 is a view of the tube of FIG. 7 according to the present invention, but with rotational lever 34 attached to the forward end, and FIG. 9 is a right side (end) view of the tube and lever of FIG. 8.

In a preferred embodiment, tube 32 has end portion 36 similar in exterior dimensions and shape to end portion 22 of guide rod 18. Key 38 is optionally provided to prevent end 36 from rotating when tube 32 is assembled to gun frame portion 24, in place of guide rod 18. Tube 32 has end 40 to which lever 34 is conveniently attached.

Tube 32 has at least two portions 42, 44 which may be moved relative to each other. Portion 42 is coupled to substantially fixed end 36 (held by gun frame portion 24) and portion 44 to lever 34. When tube 32 is assembled in gun 10, recoil spring 20 surrounds tube 32 and slide portion 28 moves along tube 32 compressing spring 20, in the same manner as for assembly 16 in FIG. 6. The mechanical action of recoil spring 20 and the spring guiding function of tube 32 are conventional and when placed in gun 10, assembly 12 performs the same mechanical function as does spring and guide rod assembly 16. However, assembly 12 of the present invention performs the additional function of providing light beam 14 aligned to weapon boresight 11. As will be presently explained, lever 34 allows portion 44 of tube 32 to be moved relative to portion 42, so as to turn light beam 14 on and off. While lever 34 is shown as having a generally rectangular or rounded rectangular shape when viewed end-on (e.g., see FIG. 9) this is merely for convenience of explanation, and lever 34 may have any convenient shape and be attached to tube 32 by any convenient means. Lever 34 can be removable to facilitate disassembly of weapon 10, but this is not essential since tube 32 conveniently breaks into two portions 42, 44.

Figure 10:
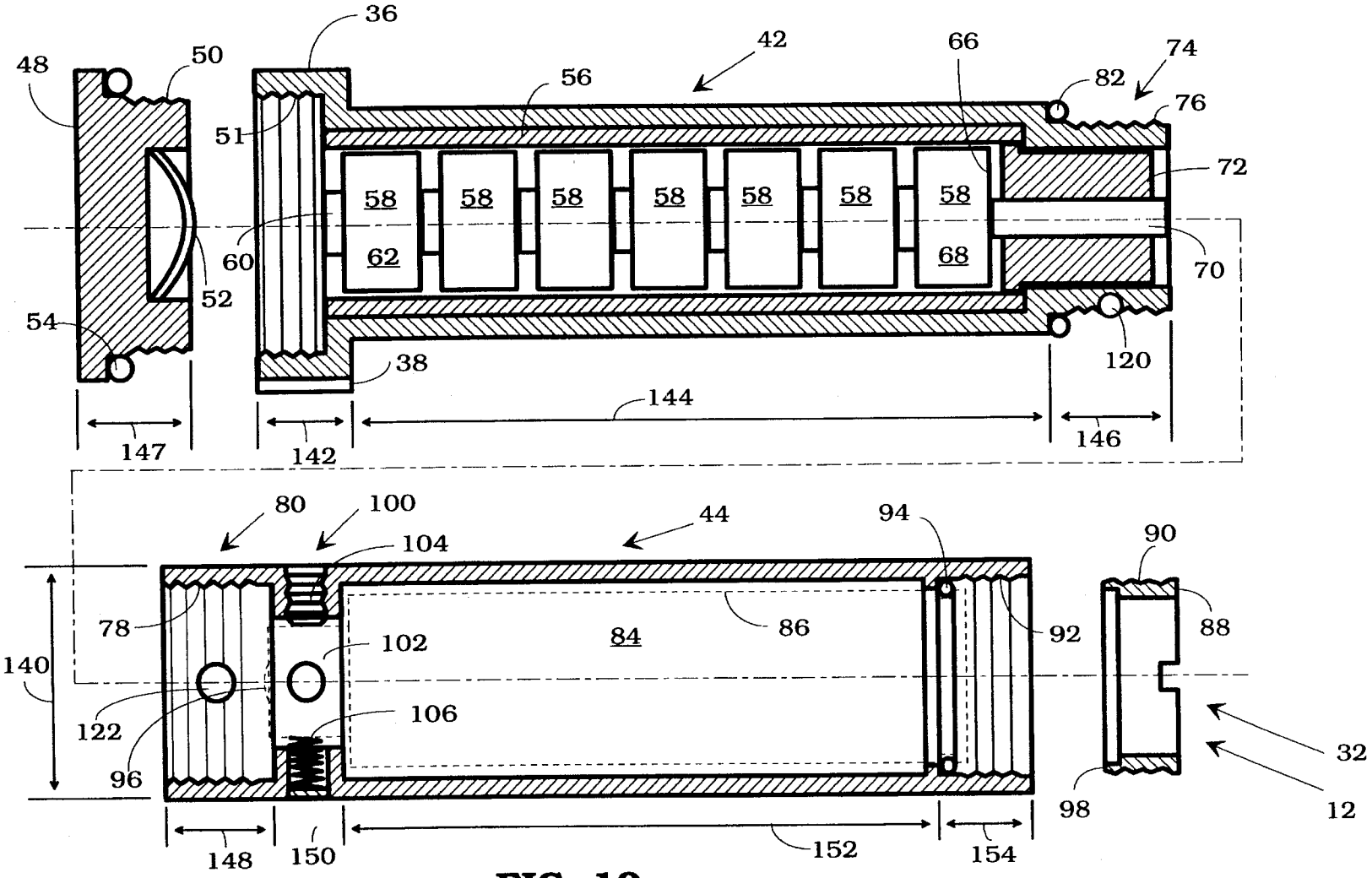
FIG. 10 is an exploded cross-sectional side and partial cut-away view of the tube of FIG. 7, showing interior details.

FIG. 10 is an exploded cross-sectional side and partial cut-away view of tube 32 of assembly 12 of FIGS. 7–9, according to the present invention and showing interior details. Lever 34 has been omitted for clarity. End region 36 of tube portion 42 comprises removable end cap 48. End cap 48 desirably engages end region 36 by means of threads 50, 51. End cap 48 comprises electrically conductive spring 52. End cap 48, end region 36 and tube portion 42 are desirably of metal, but any electrically conductive combination may be used. Any metals suitable for use in weapons is suitable.

Figure 13:
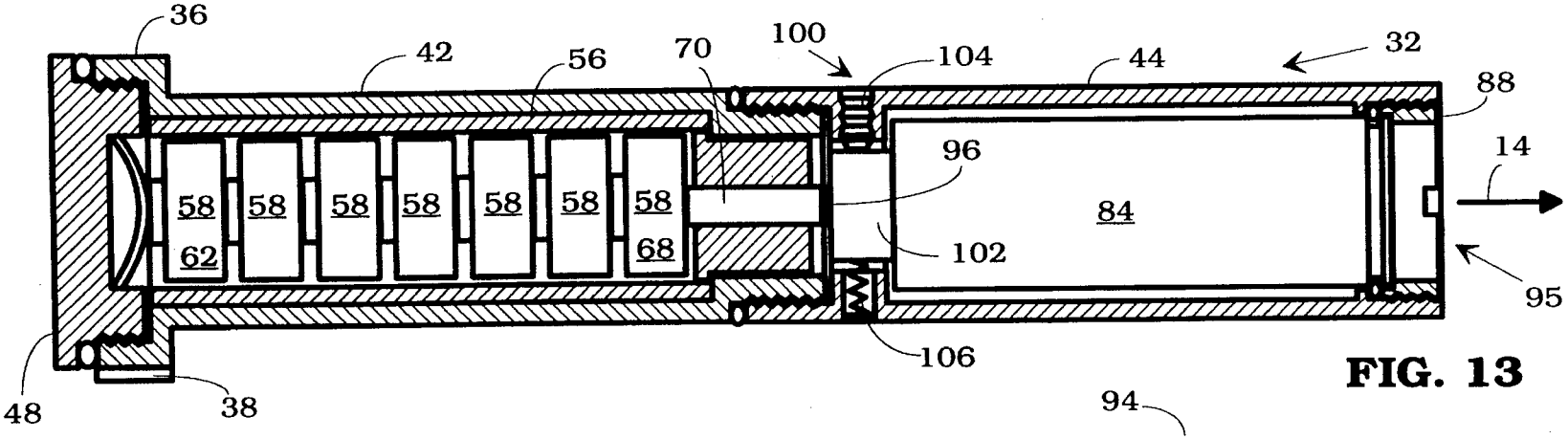
FIG. 13 is an assembled cross-sectional side and partial cut-away view of the tube of FIG. 10.

In the preferred embodiment, the mating portions of end cap 48 and end region 36 and the groove for O-ring 54 are configured so that when threads 50, 51 are fully engaged, O-ring 54 is captured and substantially surrounded by metal (see FIG. 13). Thus, in additional to providing environmental sealing, O-ring 54 acts as a resilient member which is compressed when cap 48 and end region 36 are engaged. This provides substantial friction to prevent cap 48 from moving when gun 10 is fired and to assist in absorbing the large mechanical shock received by assembly 12 receives when weapon 10 is fired. O-ring 82 is captured in a similar manner when tube portions 42, 44 are engaged. Inclusion of resilient and friction providing closure means is a particular feature of the present invention.

Portion 42 of tube 32 is hollow and contains insulating sleeve or lining 56. Contained within insulating sleeve or lining 56 are one or more batteries 58. While seven batteries 58 are illustrated in FIG. 10, this is merely for convenience of explanation, and those of skill in the art will understand that one or more batteries may be used, the particular number being chosen by the user depending upon the electrical requirements of the particular light source being employed. Thus, for the purposes of the present invention, any number of batteries may be included within portion 42, depending on the electrical demands of the light source being employed and the available space within portion 42. In the example of FIG. 10, the individual batteries are of the single button-cell variety and are arranged electrically in series. Type 393 silver oxide type batteries manufactured by the Everready Company of St. Louis, Mo. are examples of suitable batteries. They are available with dimensions that will fit within recoil spring guide tubes which fit in one or more modern day automatic pistols. However, other commonly available batteries may be employed depending upon the particular design requirements which must be satisfied (e.g., size, energy storage capacity, voltage, current, discharge rate, etc.).

When cap 48 is assembled to end region 36, spring 52 contacts pole 60 of out-board battery 62. Opposite pole 66 of in-board battery 68 contacts lead 70 held in place by insulating bushing 72 located within region 74 of tube portion 42. Lead 70 is typically of copper and insulating bushing 72 is conveniently of machinable or moldable plastic. Delrin™ is an examples of a suitable, well known and widely available Nylon™ type plastic material. Other well known plastic materials may also be used.

Region 74 of tube portion 42 desirably has threads 76 which mate with threads 78 in region 80 of tube portion 44. As was previously explained, O-ring 82 is provided not only for environmental protection, but, more importantly, to increase the resistance of assembly 12 to the shock associated with firing weapon 10. In the preferred embodiment, O-ring 82 acts as a resilient cushion that is captured and compressed when portions 42 and 44 are assembled. It provides friction to prevent undesired relative motion of portions 42, 44 and absorb shock.

Figure 11:
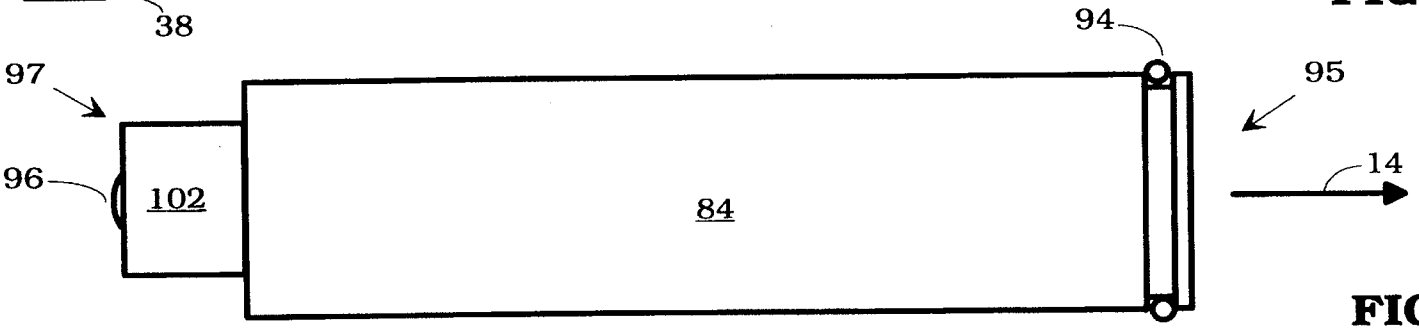
FIG. 11 is a simplified side view and FIG. 12 is a simplified cross-sectional and partial cut-away view, of a light beam generation module according to the present invention.
Figure 12:
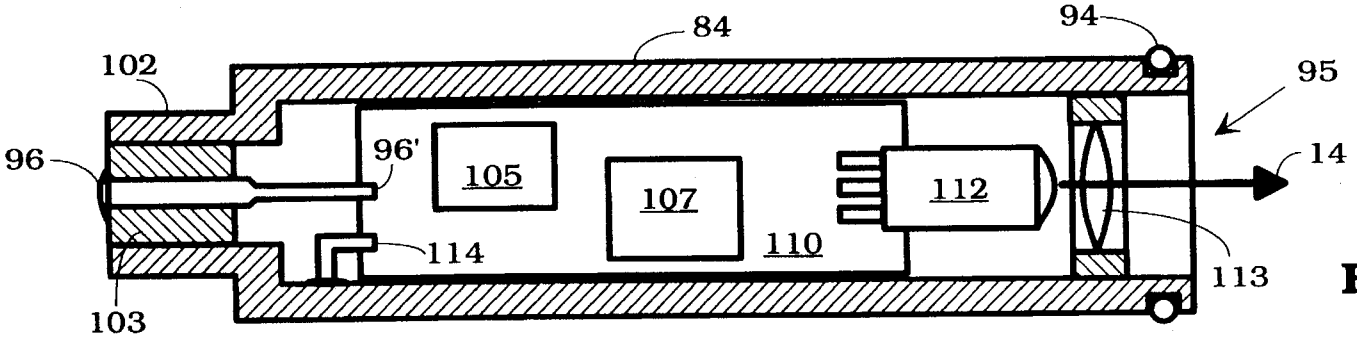

Portion 44 of tube 32 is hollow and houses light beam generating module 84 shown in further detail in FIGS. 11–12. Light beam generating module 84 is indicated in FIG. 10 by dashed outline 86 so that other details of the construction of portion 44 which would be obscured by module 84 may be seen. Module 84 is inserted into portion 44 from the right end in FIG. 10 and held in place by, for example, threaded retaining ring 88. Retaining ring 88 has threads 90 which mate with threads 92 of portion 44.

Referring now also to FIG. 11, module 84 has near end 95, O-ring 94 and near end 97, electrical contact 96. When module 84 is inserted into portion 44 and retaining ring 88 mates with portion 44, annular portion 98 of ring 88 presses against O-ring 94 to clamp module 84 within portion 44. Retaining ring 88 desirably does not touch module 84 nor does module 84 touch portion 44. Rather, module 84 is suspended within portion 84 by means of O-ring 94. In this manner, module 84 is centrally located within portion 44 and held firmly but not rigidly. The longitudinal axis of module 84 may be tilted slightly one way or another with respect to the longitudinal axis of portion 44 of tube 32. This is permitted because of the resilient nature of O-ring 94 and the manner in which it is captured between module 84, tube portion 44 and retaining ring 88. It is highly desirable to be able to tilt the longitudinal axis of module 84 so as to be able to align light beam 14 with boresight 11. In addition to allowing module 84 to be tilted, the O-ring support of end 95 aids in cushioning module 84 against the shock of gun 10 being fired. While use of O-ring 94 is an especially convenient means of providing a self-locating but adjustable and resilient mounting for module 84, other means of grasping module 84 firmly by not rigidly may be used. What is important is the module 84 be retained in a stable position within tube 32 and be slightly tiltable so that alignment of light beam 14 may be aligned to boresight 11.

Tube Portion 44 has adjacent to end region 80, alignment adjustment means 100 which bears against portion 102 of module 84. Alignment adjustment means 100 conveniently comprises opposed set screws 104 and springs 106, as for example, a pair of each oriented at right angles. Set screws 104 and springs 106 bear against region 102 of module 84. By turning set screws 104 by varying amounts, the longitudinal axis of module 84 may be tilted relative to the longitudinal axis of tube 32 so that light beam 14 becomes coaxial with the longitudinal axis of tube 32 or any other vector, e.g., boresight direction 11 (see FIG. 1). The ability to adjust the alignment of module 84 is important, since virtually all laser diodes (which are preferred as light sources) have a certain inherent amount of mis-alignment with respect to their housings and usually exhibit astigmatism. Astigmatism manifests itself in the form of the light beam 14 not being emitted from module 84 in a direction coincident with the axis of module 84.

In order to have a highly accurate light beam sight, individual adjustment of the trajectory of light beam 14 is needed. Alignment means 100 makes this possible. In general, at a least three point support is effective for alignment means 100. Two pairs of opposed springs and set screws, provide four point support which is more easily adjusted since, by arranging the screw-spring pairs to be orthogonal, the adjustments are independent. Once light beam 14 emitted from assembly 12 has been aligned to the desired direction, set screws 104 are conveniently locked in place (e.g., by a small drop of glue or paint) and no further adjustment is needed. Module 84 conveniently has an electrically conductive outer casing, as for example, metal.

An additional feature of the above-described means of suspending module 84 within tube portion 44, is that there is, at most, only a small area of thermally conductive contact between module 84 and tube 32. Conductive thermal contact from portion 44 to module 84 is through O-ring 95 and alignment means 100. O-ring 95 presents a narrow line contact through what is generally a poor thermal conductor. Alignment means 100 provides substantially point contact via, for example, set screws 104 and springs 106. Contact by screws 104 and springs 106 sufficient for electrical continuity between tube portion 44 and module 84, but provides little area for significant heat conduction between the two. Thus, module 84 is, conductively, thermally isolated from tube 32.

FIGS. 11–12, show further details of module 84. FIG. 11 is a simplified side view and FIG. 12 is a simplified cross-sectional and partial cut-away view, of light beam generation module 84 according to the present invention. Module 84 comprises, conveniently, electrical circuit 110 for actuating light source 112, e.g., an LED or laser diode, and lens 113 for focusing light beam 14. Laser diodes 112 is desirably mechanically, thermally and electrically coupled to case 85 of module 84 by metal bushing 109. Circuit 110 draws energy from batteries 58 by means of first lead 96–96', and second lead 114 or bushing 109. First lead 96–96' conveniently has end 96 exposed on the axis of module 84 opposite emergent light beam 14. Lead 96–96' is supported by insulated bushing 103. Second lead 114 and bushing 109 are conveniently electrically and mechanically coupled to conductive case 116 of module 84.

Electrical circuit 110 comprises suitable transistors or and/or integrated circuits (indicated generally by blocks 105, 107) which regulate the output from laser diode 112. Circuits for maintaining an approximately constant laser diode current and/or light output over a substantial range of battery voltage are well known in the art. For maximum battery life, it is desirable to utilize a regulating circuit which energizes laser diode 112 by means of pulses rather than continuously, but either arrangement is useful. The particular regulating circuit to be used depends upon the laser diode chosen by the designer, the number of batteries available and the voltage range over which the laser diode is required to function. Manufacturers of laser diodes and batteries provide information on the desirable operating ranges of their products which designers routinely use to select a regulator matched to their particular application. Those of skill in the art will understand how to provide a regulating circuit depending upon their choice of laser diode and batteries, without undue experimentation.

In the preferred embodiment, diode 112 is energized, moving lead 96 in portion 44 into contact with lead 70 in portion 42. This is conveniently accomplished by varying the amount by which threads 76, 78 are engaged. Twisting portion 44 relative to portion 42 causes leads 96 and 70 to make or break contact. Thus, leads 96, 70 in combination with threaded portions 74, 80 act as an electrical switch for turning laser assembly 12 on and off. Light beam 14 is turned on and off by moving portion 44 relative to portion 42. In the example shown, rotary motion of portion 44 relative to portion 42 causes leads 96, 70 to approach or retract from each other. While this arrangement is preferred, it is not essential, and as those of skill in the art will understand based on the description herein, any means of moving portion 44 relative to portion 42 (or vice-versa) can be used to make or break a contact between leads 96, 70 and thus, control the electrical circuit. For example, threats 74, 78 may be omitted and portions 44, 42 slide together and apart. However, the use of screw threads for engaging and disengaging leads 69, 70 is preferred.

During assembly of tube 32, portions 44 and 42 are screwed together until only about one-quarter turn is needed to make or break the contact between leads 96, 70. Lever 34 is fixed to tube 32 (e.g., by a set screw) so that rotating lever 34 around the axis of tube 32 by approximately ninety degrees brings leads 96, 70 into contact (or apart) and causes light beam 14 to be activated (or de-activated). In order to have positive "on" and "off" positions, captured ball 120 is desirably provided in threaded region 74 and matching detents 122 are provided about ninety degrees apart in threaded region 80 of portion 42, or vice-versa. Plastic (e.g., Nylon™) may be used for ball 120 so that some resilience is built-in. FIG. 13 is an assembled cross-sectional side and partial cut-away view of the tube of FIG. 10. Those of skill in the art will understand, based on the description herein, how to form tube 32 and bushing 72 without undue experimentation.

Figure 14:
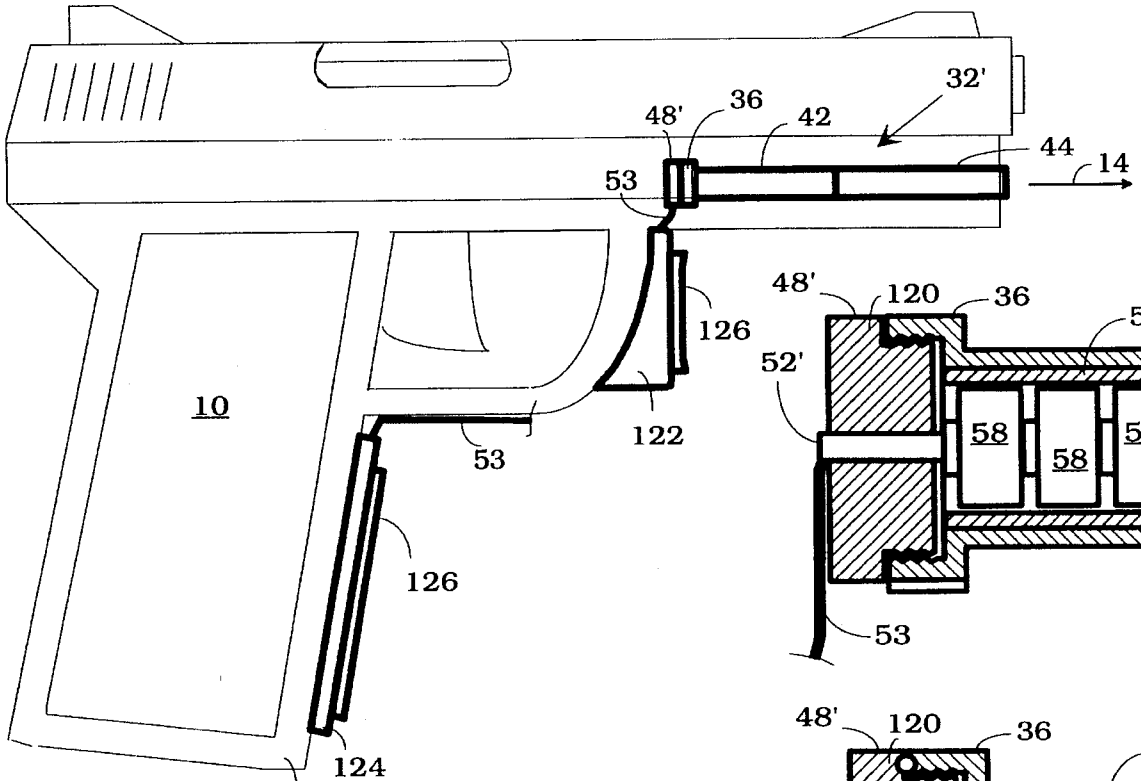
FIG. 14 is simplified phantom side view of pistol 10 similar to FIG. 1, but with a modified recoil spring guide tube according to a further embodiment of the present invention, installed therein.
Figure 15:
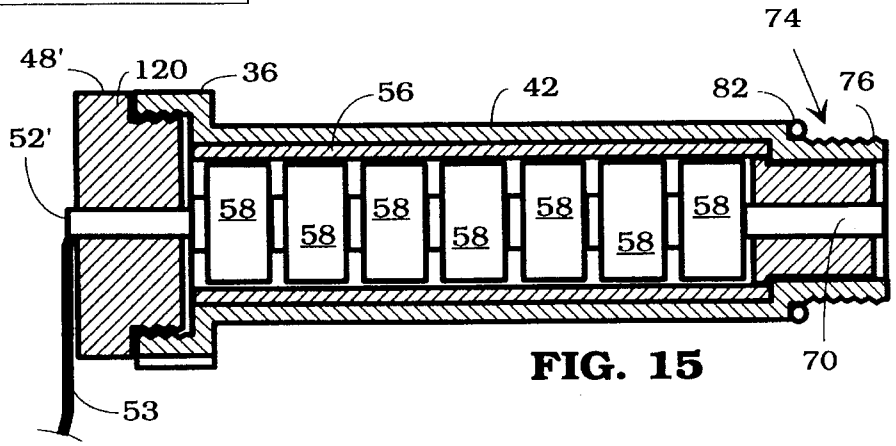
FIGS. 15–16 are partial cut-away and cross-sectional side views of a portion of the recoil spring guide tube of FIG. 14, showing further detail.
Figure 16:
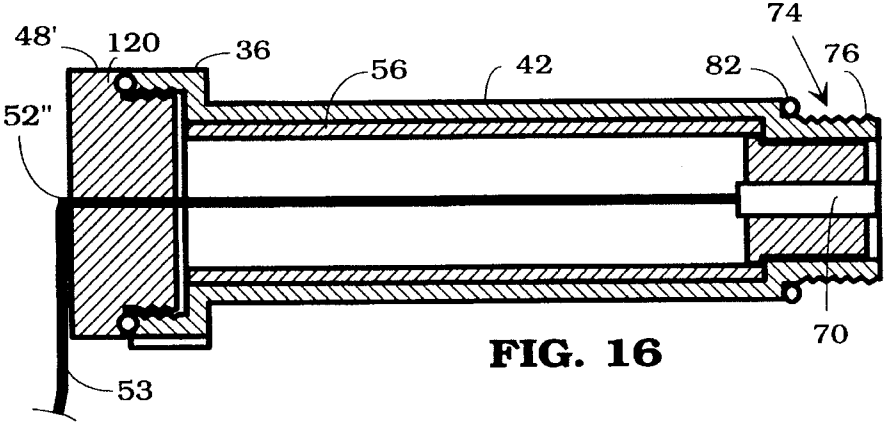
Figure 17:
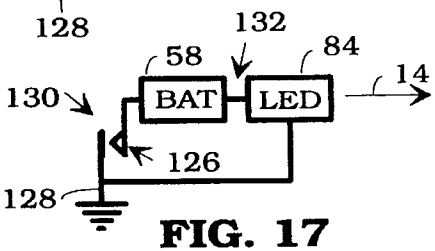
FIG. 17 is a simplified electrical schematic of the arrangement of FIGS. 14–16.

FIG. 14 is simplified phantom side view of pistol 10 similar to FIG. 1, but with modified recoil spring guide tube 32 according to a further embodiment of the present invention, installed therein. The recoil spring has been omitted for clarity. FIGS. 15–16 are partial cut-away and cross-sectional side views of portion 42 of the recoil spring guide tube of FIG. 14, showing further detail, and FIG. 17 is a simplified electrical schematic of the arrangement of FIGS. 14–16.

Portions 42 and 44 of tube 32' are assembled such that leads 69 and 70 are in electrical contact. End portion 48' of tube 32' is modified to provide insulated bushing 120 through which extends conductor 52' (FIG. 15) or 52" (FIG. 16). Conductors 52', 52" are coupled to insulated lead 53 which extends from tube 32' to switch 122 or 124 mounted to frame 128 of gun 10. Switch 122 is conveniently mounted to the forward portion of the trigger guard and switch 124 is conveniently mounted to the forward edge of the butt. Either arrangement is useful and other locations on the gun, e.g., along the side of the weapon, may also be used as a location for switch 122, 124. Switches 122, 124 are activated by depressing button or pad 126 which causes switch 130 to close (see FIG. 17), thereby coupling the electrical signal through the frame of the gun back to laser module 84. This is possible because most pistols utilize metal frames and module 84 conveniently has conductive housing 86 to which one lead of circuit 110 is coupled, e.g., lead 114 or bushing 109, as shown for example in FIG. 12. In those instances where pistol 10 lacks a metal frame, an additional wire is used to provide continuity back to conductive spring guide tube 32.

FIG. 15 illustrates an embodiment in which batteries 58 are provided in tube portion 42 in substantially the same manner as already described, but where the on/off switching function for energizing laser diode 112 is accomplished by switch 122 or 124. FIG. 16 illustrates a further embodiment in which batteries 58 are omitted from tube 32 and placed in switch 122 or 124 or elsewhere in the weapon. In this embodiment, switch 130 is at location 132 in the circuit of FIG. 17. Either arrangement is satisfactory. However, having batteries, laser diode and switch 69, 70 within tube 32, as is shown for example in FIG. 13, avoids external switches 122, 124 and keeps the outer profile of the weapon especially clean and free from protrusions. This is desirable.

The following is an example of the construction of a fully self-contained internally mountable laser sighting assembly according to the present invention. Referring now to FIG. 10, a laser beam generation apparatus is constructed according to the present invention. Tube 32 has outer diameter 140 of about 0.34 inches, i.e., to fit a commonly available automatic pistol. Portion 36 has length 142 of about 0.165 inches, portion 42 has central length 144 of about 1.325 inches, and externally threaded length 146 of about 0.4 inches, including the space for O-ring 82. End cap 48 has length 147 of about 0.15 inches. Tube portion 44 has internally threaded length 148 of about 0.425 inches, including small clearance regions at the beginning and end of the threads, adjustment region length 150 of about 0.125 inches, central chamber length 152 of about 1.475 inches and internally threaded length 154 of about 0.20. Retention ring 88 is sized to fit within threaded portion 92 of tube portion 44 and engage O-ring 94 to flexibly retain module 84, as previously described. Module 84 had an outer diameter less than 0.31 inches so as to fit within the bore of that size in the central part of tube portion 44. Lyte Optronics of Santa Monica, Calif. supplies a laser module of a size which will fit within a tube of 0.31 inch bore and such laser module is suitable for use as laser module 84 of the present invention. Insulated spacer 72 is conveniently of Delrin™. Tube 32 and portions 42, 44, 48 and 88 are conveniently fabricated from metal. Brass is suitable where fine threads and easy machinability are desired and iron alloys are more suitable for those portions which encounter heavy mechanical abrasion, as for example, from caused by recoil spring 20. Those of skill in the art will understand based on the description herein how to choose appropriate materials for constructing tube 32 and its various parts. Silver oxide batteries were used.

For proper operation, it is important to adjust the alignment of module 84 within tube portion 44 of tube 32 to provide light beam 14 in the correct direction. This is because laser diodes exhibit various optical anomalies which cause the beam emitted thereby to differ from the geometric axis of the laser diode package or housing. Thus, provision is made using alignment means 100 for aligning module 84 to provide beam 14 exiting in the desired direction, i.e., parallel to boresight 11. This is accomplished by placing tube portion 44 or assembled tube 32 in an alignment fixture having a known relationship to boresight 11 and adjusting screws 104 until beam 14 falls at the correct location relative to the boresight.

However, it is preferable to install tube 32 within weapon 10 and, with slide 13 retracted or removed, adjust screws 104 (or other adjustment means 100) until beam 14 is aligned with boresight 11, which alignment can be determined directly. Alignment of module 84 in-situ compensates for any tolerance variations and/or misalignment of the gun components, and misalignment and/or variation (e.g., astigmatism) of the laser module components. The ability to adjust the aiming point of beam 14 is an important advantage of the present invention, for several reasons. First, not all recoil spring guide tubes are installed in weapons parallel to the barrel. Thus, if there is no means of adjusting beam 14 it will not coincide with the boresight. Second, actual bullet trajectories vary with bullet shape, size and weight, and with the powder load. Thus, even when the barrel is aligned with the guide tube, a need exists to be able to move the aiming point relative to the boresight to compensate for differences in bullet trajectory due to differences in ammunition. Third, it is desirable to be able to set the aiming point for different distances, i.e., to compensate for different amounts of drop for different ranges. Thus, the laser sight maybe set to show the bullet impact point at a range of 25 yards, or 50 yards, or whatever distance the shooter desires. The present arrangement allows such adjustment. Screws 104 are desirably of a high friction type so that they do not move when the gun is fired. If it is desired to fix screws 104 in a given position this is easily accomplished with a drop of cement or paint or the like.

The ability to mode module 84 to be adjusted in tilt relative to the axis of tube 32 and/or boresight 11 is important. Module 84 is resiliently mounted in tube portion 44 by O-ring 94, retention ring 88, and adjustment means 100. This is an important aspects of the present invention, since it permits the deficiencies of typical laser diodes or other light sources (and variations in the gun) to be largely compensated before or after installation of tube 32 and assembly 12 in gun 10.

Laser module 84 is substantially thermally isolated so far as conductive head transfer from weapon 10 through tube 32 is concerned., This is because module 84 is suspended within tube 32 by small area (e.g. line) contact to O-ring 94 and small area (e.g., point) contact to alignment means 100. There is no large area thermal contact between module 84 and tube 32 and/or weapon 10. The heat generated within diode 112 is small compared to the heat generated by firing weapon 10. For example, shooting 50–100 rounds in a short period of time can raise the barrel temperature to 300°–400° F. Without the thermal isolation provided by the invented arrangement, heat from barrel 30 would be rapidly conducted to diode 112, thereby degrading its performance. At about 140° F., most laser diodes stop emitting. Thus, providing conductive thermal isolation to aid in avoiding significant heat coupling to diode 112 is an important feature of the present invention.

Figures 18, 19, 20, 21, 22, 23, 24:
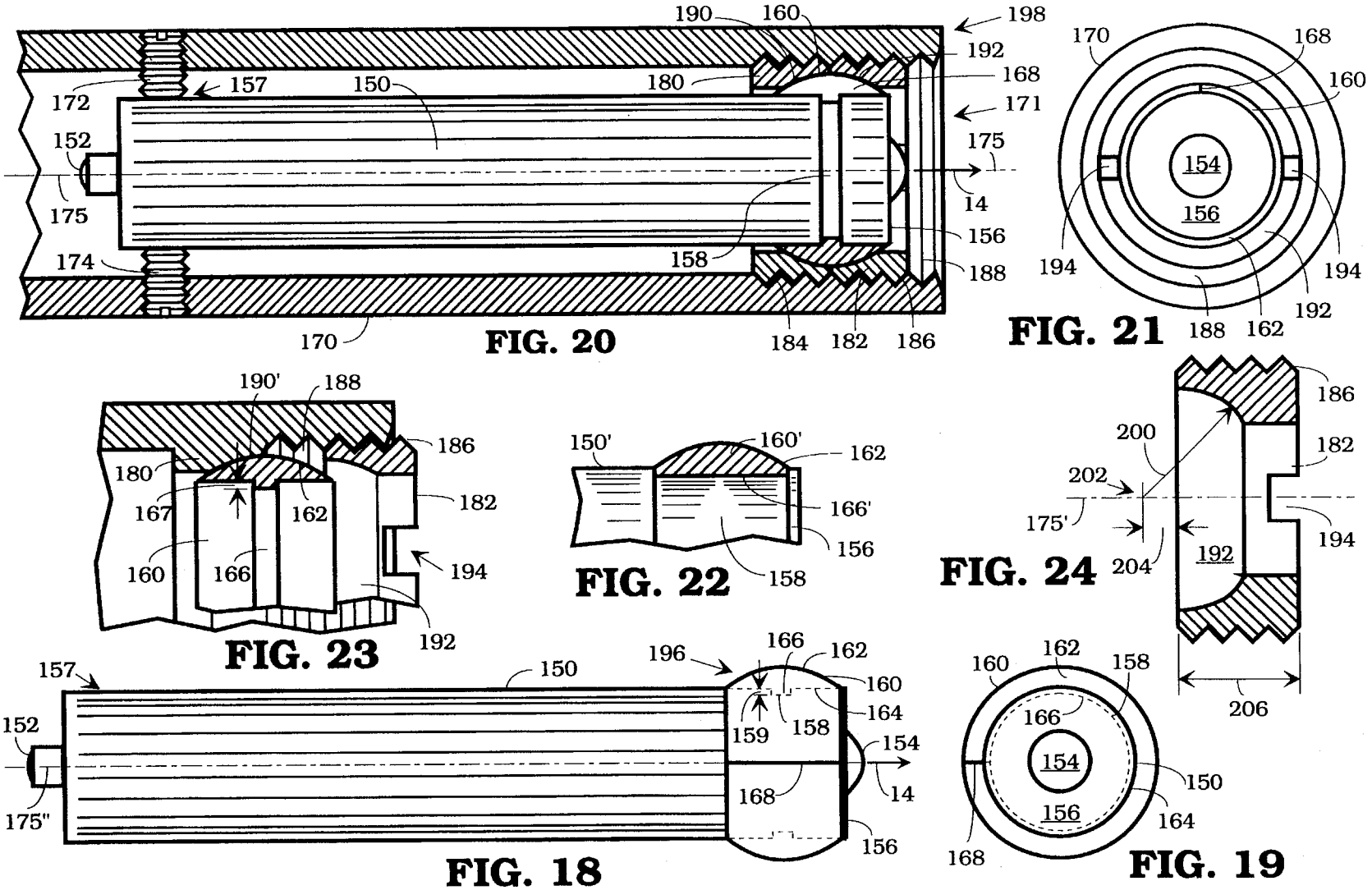
FIG. 18 is a simplified side view and FIG. 19 is a simplified end view of a light beam generation module analogous to that of FIGS. 11–12 but according to a further embodiment of the present invention.
FIG. 20 is a simplified partial cut-away and cross-sectional view showing the module of FIGS. 18–19 mounted in a housing analogous to that of FIG. 13, but according to a further embodiment of the present invention
FIG. 21 is a simplified end view of the housing and module of FIG. 20.
FIG. 22 is a simplified partial cut-away and cross-sectional view of a portion of the upper right comer of the module of FIG. 18 but according to a still further embodiment.
FIG. 23 is a simplified partial cut-away and cross-sectional view of a portion of the upper right comer of the housing of FIG. 20 in the process of assembly, but according to a still further embodiment of the present invention.
FIG. 24 is a simplified cross-section through a retaining ring used for holding the module within the housing of FIG. 23.

FIG. 18 is a simplified side view and FIG. 19 is a simplified end view of light beam generation module 150 analogous to module 84 of FIGS. 11–12 but according to a further embodiment of the present invention. Module 150 is conveniently constructed of the same materials and in substantially the same way as module 84 and performs substantially the same function as module 84. Module 150 has electrical contact 152 analogous to contact 96 of module 84 and lens or window 154 through which light beam 14 emerges. Module 150 has notch 158 of radial depth 159 near light emitting end 156. Notch 158 differs slightly from the notch in module 84 in order to accommodate circular ring 160 shown in FIG. 18. While notch 158 is preferably circumferential like the notch in module 84 for O-ring 94, that is, extending around the entire outer circumference of module 150, this is not essential. All that is needed is a notch of sufficient longitudinal (parallel to the long dimension of module 150), depth (radially with respect to module 150) and circumferential extent with respect to module 150 that it prevents circular ring 160 from moving longitudinally with respect to module 150. For example, notch 158 can be in the form of one or more circular or rectangular depressions at one or more locations around the circumference of module 150. Any means of retaining ring 160 on module 150 that does not interfere with the other requirements of module 150, will serve. Mating protrusions should be provided in circumferential ring 160. Conversely, module 150 can contain a protrusion and ring 160 a mating notch or depression to prevent longitudinal motion. Either arrangement is satisfactory.

Ring 160 desirably has an annular shape that extends around the circumference of module 150. Ring 160 has convex outer surface 162 which is desirably curved three dimensions, as for example, forming a portion of a sphere or other curved three dimensional shape whose center is at the mid-point of the ring. A spherical contour is preferred. Inner surface 164 of circular ring 160 is preferably of cylindrical shape with inwardly protruding annular ridge 166 of radial height 167 (see FIG. 23) that mates with notch 158 of depth 159 (see FIG. 18), but this is not essential. Any interior shape may be utilized as long as it engages a matching shape in module 150. Radial height 167 of protrusion 166 should be less than or equal radial depth 159 of notch 158. As noted above, protrusion 166 can be formed in module 150 and notch 158 in ring 160.

Annular ring 160 is desirably split at cut-surface 168. Cut surface 168 extends through ring 160 so that it may be sprung apart enough to slip over end 156 of module 150 until protrusion 166 engages notch 158. Cut surface 168 may be at right angles to the plane of the ring or at any other convenient angle passing through the ring from front to back. Once ring 160 is in place so that protrusion 166 engages notch 158, it is retained in place on module 150 by its tendency to retain its closed annular shape.

Ring 160 may be of metal, plastic or ceramic. It is desirably of a material having poor thermal conductivity compared to steels and the like and of sufficient hardness so as to substantially retain its shape under compressive and shock loads without significant plastic flow. Delrin® and other forms of machinable nylon are examples of suitable materials. However, other plastics such as poly carbonate, Teflon, acrylics and the like may also be used. Ceramics may also be used, but because of their great rigidity, two cut surfaces must generally be provided, i.e., the annular ring is split into two parts, in order for it to be assembled onto module 150. Once module 150 with ring 160 has been assembled into housing 170 (see FIG. 20) then the split ceramic ring is automatically retained in place. However, a one-piece ring with one cut surface is easier to use.

In the preferred embodiment, ring 160 is separable from module 150 and of a material (e.g., Delrin) different than module 150, but neither is essential. Ring 160 may be formed as part of module 150 (i.e., not removable) and may be of the same material as module 150 or of a different material. Either arrangement is useful.

FIG. 20 is a simplified partial cut-away and cross-sectional view showing module 150 of FIGS. 18–19 mounted in housing 170 analogous to housing 44 of FIG. 13, but according to a further embodiment of the present invention and FIG. 21 is a simplified end view of housing 170 and module 150 of FIG. 20 looking toward output end 171 of module 170. Housing 170 has adjustment screws 172, 174 analogous to adjustment screws 104 of housing 44. While housing 170 is shown as having adjustment screws 172, 174, those of skill in the art will understand based on the description herein that one or more may be replaced with springs analogous to spring 106. The purpose of screws 172, 174 (or a screw and opposed spring) is to allow end region 157 of module 150 to be moved transverse to longitudinal axis 175 of housing 170 so that light beam 14 may be aimed at different angles with respect to axis 175 of housing 170, in much the same manner as previously described for module 84 and housing 44. Sufficient screws or screws and springs should be used to allow adjustment of beam 14 in any direction. By using two screws and two opposed springs, with the two screw-spring pairs arranged at right angles, orthogonal adjustment is obtained, which is preferred.

End 156 of module 150 with ring 160 is conveniently held within housing 170 by means of annular rings 180, 182. Annular rings 180, 182 have threads 184, 186 on their outer circumferences which mate with threads 188 on the interior of housing 170. Rings 180, 182 have, respectively, interior concave curved surfaces 190, 192 that mate with convex curved surface 162 of ring 160. Rings 180, 182 conveniently have transverse (i.e., radial) notches 194 that extend part way into the rings to allow a flat blade (not shown) to be inserted therein to screw them into housing 170. The end of the blade that is inserted into housing 170 to tighten or loosen rings 180, 182 conveniently has longitudinally protruding portions at the extremities of the blade that engage notches 194 and a central recess between the protrusions so that the blade does not contact module 150 or lens 154.

To assemble module 150 into housing 170 in the position shown in FIGS. 20–21, screws (or screws and springs) 172, 174 are retraced or removed, and first mounting ring 180 is screwed into threads 188 of housing 170 so that it is tight and concave curved interior surface 190 of first mounting ring 180 facing output end 171 of housing 170. Module 150 is then inserted into housing 170 so that convex surface 162 of ring 160 on module 150 mates with concave surface 190 of ring 180 in housing 170. Second mounting ring 192 is then screwed into threads 188 of housing 170 until concave surface 192 of ring 182 engages convex surface 162 of ring 160.

Ring 182 is tightened until a snug fit is obtained, that is, sufficient to prevent any significant longitudinal or lateral motion of end 156 of module 150, while allowing ring 160 and module 150 to rotate within mounting rings 180, 182 as screws 172, 174 are adjusted so that the angle of inclination of light beam 14 with respect to axis 175 of housing 170 may be adjusted. For example, in a preferred embodiment, a ±0.76 mm radial movement of screws 172, 174 were sufficient to deflect beam 14 transversely by about 3 meters at a distance of about 90 meters, that is, providing about 12 degrees angular deflection of the light beam. As has been previously described in connection with the other embodiments, this adjustment feature is important to proper alignment and aiming of light beam 14 within weapon 13 or any other apparatus in which it is used.

FIG. 22 is a simplified partial cut-away and cross-sectional view of a portion of upper right comer 196 of module 150 of FIG. 18 but according to a still further embodiment. Ring 160' of FIG. 22 has similar curved outer surface 162, but protrusion 166' and notch 158' are as wide as ring 160'. In other respects, ring 160' is similar to ring 160. Ring 160' is slightly simpler to fabricate. Because of the additional material that is included by widening protrusion 166', ring 160' is somewhat harder to spring apart to slip over end 156 of module 150. This may be relieved by making the radial thickness of protrusion 166' smaller.

FIG. 23 is a simplified partial cut-away and cross-sectional view of a portion of upper right comer 198 of housing 170 and ring 160 of FIG. 20 in the process of assembly, but according to a still further embodiment of the present invention. In FIG. 23, first mounting ring 180 is replaced by annular boss 180' integral with housing 170 and having interior concave curved surface 190' analogous to surface 190. Ring 160 (and housing 150, not shown in FIG. 23) is inserted into housing 170 in the same manner it would after first mounting ring 180 has been installed in housing 170. Mounting ring 182 is then screwed into threads 188 of housing 170 in the same manner as has previously been described. To facilitate understanding, in FIG. 23, ring 182 is shown partly screwed toward its final position wherein surface 192 of ring 182 would engage surface 162 of ring 160. The arrangement of FIG. 23 has the advantage of requiring fewer piece parts, but in exchange for greater complexity in the fabrication of housing 170. Either arrangement is satisfactory.

FIG. 24 is a simplified cross-section through ring 182 separated from housing 170. Ring 182 has the shape of a short hollow cylinder with threads 186 on its outer surface and with portion 192 of its inner surface forming part of a sphere. Surface 192 has predetermined radius 200 measured from center 202. Center 202 lies substantially on the longitudinal axis of ring 182 (i.e., left-right axis in FIGS. 23–24) which is, when installed in housing 170, substantially coincident with the longitudinal axis of housing 170. Center 202 lies substantially on the longitudinal axis of ring 182 and outside of ring 182 by amount 204.

After module 150 has been mounted in housing 170 and adjusted (e.g., via screws 172, 174) to provide the desired angular orientation of beam 14, it is desirable to apply to ring 182 and screws 172, 174 a material that prevents slippage or loosening of the threaded connections. Air hardening cements and other materials suitable for this purpose are well known in the art.

As an example, for module 150 with an outer diameter of about 6.4 mm, Delrin ring 160 has an interior diameter of about 6.6 mm (about 0.13 mm radial clearance) and a longitudinal front-to-back (e.g., left-to-right- in FIGS. 18, 20, 22, 23) thickness of about 4.4 mm, and protrusion 166 has a longitudinal width of about 0.76 mm. Protrusion 166 projects radially inward from the interior diameter of ring 160 by about 0.76 mm. Curve 162 is a spherical surface with a radius of about 4.0 mm. Mounting rings 180, 182 are machined from brass and have a longitudinal thickness of about 1.9 mm. Surfaces 190, 192 have a radius of about 4.4 mm measured from a center off-set outwardly from one the face of the ring by about 0.8 mm. Rings 180, 182 have an interior diameter of about 6.9 mm and slots 194 are about 1.3 mm wide by about 0.9 mm deep. Threads 184, 186, 188 are nominally 11/32-32 in US units. Module 150 and housing 170 are machined from stainless steel, but other materials can also be used.

The mounting arrangement shown in FIGS. 18–24 has the advantage that it is more shock resistant than the mounting described in connection with FIGS. 11–13 using a rubber O-ring. Comparative gun firing tests showed that less misalignment of module and light beam deflection occurred during firing when Delrin ring 160 as described herein was used, as compared to module 44 using ring 94 made of rubber. In making the tests, otherwise substantially identical modules and housings were placed into a gun in the manner described herein and the gun fired using similar powder loads. This greater shock resistance is a significant advantage since, if module 44 or 150 becomes misaligned in use, the gun must generally be disassembled in order that module 44, 150 and light beam 14 can be realigned to provide proper sighting.

It is apparent based on the above description that the present invention provides an improved means and method for supporting and aligning a light emitting module and, usefully, an internally mountable light emitting module aiming device for weapons and weapons containing such. The improved module mounting arrangement is particularly useful in connection with laser sights for weapons but may be used in other applications as well.

Further, the present invention permits the laser module to be properly aligned to compensate for astigmatism and other optical imperfections common in laser diodes, and for machining tolerances. In connection with weapons, it allows reliable compensation for variations in bullet and powder load, so that the accuracy of the laser sight is not substantially degraded by such. In addition, the invented arrangement requires very little if any modification of the gun. It is easily adaptable to a large variety of weapons using recoil spring guide rods or tubes. The shock resistance is substantially improved. These are desirable features.

Having thus described the invention, those of skill in the art will appreciate that numerous modifications can be made from the arrangements illustrated for purposes of explanation without departing from the spirit of the present invention. Accordingly, it is intended to include these and such other variations as will occur to those of skill in the art based on the description herein, in the claims that follow.

What is claimed is:

1. An assembly for projecting an angularly adjustable light beam, comprising a hollow enclosure having therein a partly spherical interior surface of predetermined radius, a light beam generation module within the enclosure and coupled to the enclosure proximate a first end of the module by a collar having a partly spherical outer surface for rotatably engaging the partly spherical interior surface, wherein the collar has therein a through-cut so that the collar may be temporarily expanded to allow the collar to engage the module; and said assembly further includes an adjustment mechanism operative upon the distal end of the module for varying the alignment of the module relative to said enclosure.

2. An adjustable light beam generation assembly, comprising:

a hollow tube having a first longitudinal axis and a concave interior surface region of a predetermined radius;

a laser diode module mounted within the tube and having a second longitudinal axis and having a first end wherefrom a light beam emerges and projects out of the tube and having a second distal end, wherein the module has a first diameter proximate the first end;

a mounting collar portion on the module near the first end and having a length parallel to the second axis and a thickness perpendicular to the second axis less than the length, wherein the mounting collar portion has a convex exterior surface region which matingly engages the concave interior surface region of the tube so as permit relative angular displacement of the first and second axes by rotation of the convex exterior surface region of the collar portion relative to the concave interior surface region of the tube; and at least one adjustment screw, disposed proximate to a distal end of the module for deflecting the second axis relative to the first axis.

3. The assembly of claim 2 wherein the predetermined radius exceeds one half of the first diameter.

4. The assembly of claim 2 wherein the concave interior surface region has a center lying on the first axis.

5. The assembly of claim 2 wherein the collar portion has a hollow ring-like shape which is cut through from exterior to interior in at least one location.

6. The assembly of claim 2 wherein the collar portion is separable from the module and has a substantially cylindrical interior surface engaging a mating region of the module.

7. The assembly of claim 2 wherein the collar portion is separable from the module and has an interior surface with an inwardly protruding ridge for engaging a matching groove in an exterior surface of the module.

8. The assembly of claim 2 wherein the concave interior surface region of the tube comprises two portions, at least one of which is removable from the tube.

9. The assembly of claim 8 wherein at least one removable portion comprises a threaded exterior surface matching corresponding threads in the tube.

10. The assembly of claim 9 wherein the at least one removable portion comprises a short hollow cylinder whose concave interior surface region is partly spherical with a center lying on the first axis beyond an end of the cylinder.

11. An assembly having an adjustable light beam, comprising:

a housing having a portion comprising an elongated hollow bore with a first longitudinal axis;

a hollow tube coupled to the housing in approximate parallel alignment with the hollow bore, wherein the tube has a second longitudinal axis and a concave interior surface region of a predetermined radius;

an electrically operated light beam generation module adjustably mounted within the tube and having a third longitudinal axis and having a first end wherefrom a light beam emerges and projects out of the tube and having a second distal end;

a convex mounting region on the module near the first end and having a length parallel to the third axis and a thickness perpendicular to the third axis which is less than the length, wherein the convex mounting region matingly engages the concave interior surface region of the tube to permit relative angular displacement of the second and third axes by rotation of the convex mounting region relative to the concave interior surface region of the tube; and a switch coupled to the housing and electrically interposed between an energy source and the light beam generation module for turning the light beam on and off.

12. The assembly of claim 11 wherein the tube comprises one or more adjustment screws proximate to a distal end of the module for deflecting the third axis relative to the second axis.

13. The assembly of claim 11 wherein the concave interior surface region of the tube comprises first and second portions one of which is located on a removable ring.

14. The assembly of claim 13 wherein the removable ring has a threaded exterior surface and the tube has matching interior threads.

15. The assembly of claim 13 wherein the second portion of the concave interior surface has a center lying on the second axis.

16. The assembly of claim 15 wherein the center lies on the second axis beyond an end of the tube.

17. The assembly of claim 11 wherein the convex mounting region is a separable collar which is cut through from exterior to interior in at least one location.

18. The assembly of claim 17 wherein the collar has a substantially cylindrical interior surface engaging a matching region of the module.

19. The assembly of claim 17 wherein the collar is ring-shaped with an interior facing surface and the module has an outward facing surface underlying the interior facing surface of the collar and the outward facing surface of the module and the interior facing surface of the collar engage so as to prevent longitudinal displacement of the collar relative to the module, once the collar and module are assembled.

* * * * *